US007163012B2

(12) United States Patent
Delphia

(10) Patent No.: US 7,163,012 B2
(45) Date of Patent: Jan. 16, 2007

(54) DIVING SNORKEL ASSEMBLY INCLUDING A CASING

(76) Inventor: John B. Delphia, 723 Tournament Cir., Norton Shores, MI (US) 49444

( * ) Notice: Subject to any disclaimer, the term of this patent is extended or adjusted under 35 U.S.C. 154(b) by 0 days.

(21) Appl. No.: 11/357,691

(22) Filed: Feb. 17, 2006

(65) Prior Publication Data

US 2006/0185667 A1 Aug. 24, 2006

Related U.S. Application Data

(60) Provisional application No. 60/654,337, filed on Feb. 18, 2005.

(51) Int. Cl.
*B63C 11/16* (2006.01)

(52) U.S. Cl. ..... 128/201.11; 128/201.26; 128/200.29; 405/186; 405/187; 24/457; 24/458; 248/122.1; 248/125.1; 248/125.3

(58) Field of Classification Search ..... 128/201.11, 128/201.26, 201.27, 201.28, 200.29; 405/186, 405/187; 24/457, 458; 248/122.1, 125.1, 248/125.3

See application file for complete search history.

(56) References Cited

U.S. PATENT DOCUMENTS

| | | | | | |
|---|---|---|---|---|---|
| 2,362,240 | A | * | 11/1944 | Bonilla | 128/201.11 |
| 4,071,024 | A | * | 1/1978 | Blanc | 128/201.11 |
| 4,095,592 | A | | 6/1978 | Delphia | |
| 4,610,246 | A | | 9/1986 | Delphia | |
| 4,655,212 | A | | 4/1987 | Delphia | |
| 4,805,610 | A | * | 2/1989 | Hunt | 128/201.11 |
| 4,879,995 | A | | 11/1989 | Christianson | |
| 5,117,817 | A | * | 6/1992 | Lin | 128/201.11 |
| 5,143,059 | A | | 9/1992 | Delphia | |
| 5,239,990 | A | | 8/1993 | Delphia | |
| 5,487,379 | A | * | 1/1996 | Koshiishi | 128/201.11 |
| 5,664,558 | A | * | 9/1997 | Wagner | 128/201.11 |
| 6,129,081 | A | | 10/2000 | Wu | |
| 6,302,102 | B1 | * | 10/2001 | Giroux et al. | 128/201.11 |
| 6,655,378 | B1 | | 12/2003 | Swetish | |
| 6,668,822 | B1 | | 12/2003 | Monnich | |
| 6,827,083 | B1 | * | 12/2004 | Kawashima et al. | 128/201.11 |
| 6,915,800 | B1 | * | 7/2005 | Hwang | 128/201.11 |
| 7,047,965 | B1 | * | 5/2006 | Ball | 128/201.11 |

* cited by examiner

*Primary Examiner*—Henry Bennett
*Assistant Examiner*—Nihir Patel
(74) *Attorney, Agent, or Firm*—Howard & Howard Attorneys, P.C.

(57) ABSTRACT

A diving snorkel assembly includes a snorkel tube and a casing. The snorkel tube includes a first portion and a second portion telescopically disposed relative to each other. The snorkel tube further includes an inner surface that defines an air passageway. The air passageway extends through the first portion and the second portion between a first end and a second end of the snorkel tube. A casing surrounds at least part of the first portion and the second portion. An interior of the casing is in fluid isolation from the air passageway. Due to the fluid isolation between the air passageway and the interior of the casing, mechanical mechanisms are sufficient to secure the casing in place such that the diving snorkel assembly may be made without the use of glue.

20 Claims, 6 Drawing Sheets

DIVING SNORKEL ASSEMBLY INCLUDING A CASING

CROSS REFERENCE TO RELATED APPLICATION

This application claims the benefit of U.S. Provisional Application Ser. No. 60/654,337 filed Feb. 18, 2005.

BACKGROUND OF THE INVENTION

1. Field of the Invention

The subject invention relates to a diving snorkel assembly. More specifically, the subject invention relates to a diving snorkel assembly including a snorkel tube and a casing surrounding at least part of the snorkel tube.

2. Description of the Prior Art

Diving snorkel assemblies include an inner surface defining an air passageway extending between a first end and a second end of the snorkel tube to enable a skin diver to breath underwater. In modern diving snorkel assemblies, the snorkel tube may includes different portions that perform different functions within the snorkel tube. For example, the snorkel tube may include various features such as a water trap and various valves dedicated to air intake, air exhaust, water purging, or a combination of those functions. Such features are added onto the snorkel tube in a separate step during manufacturing. For example, a portion of the snorkel tube may be manufactured to include the feature. The portion of the tube including the feature may be assembled with another portion of the snorkel tube. The resulting snorkel tubes made from the two separate portions are typically flimsy and are not water tight. As such, additional processing steps may be required to seal the snorkel tubes and/or reinforce the snorkel tubes, such as gluing the various portions together.

Diving snorkel assemblies further require excellent strength and surface appearance properties. As such, snorkel tubes typically must be formed from materials that are resistant to cracking, deformation, or other failure during use. Furthermore, the snorkel tubes are typically required to have an excellent surface appearance to be visually appealing to customers. As such, relatively expensive materials are required, as are relatively expensive manufacturing steps such as injection molding, in order to make suitable snorkel tubes.

Furthermore, known assemblies typically have a fixed color or design once manufactured, and there is no way to quickly and efficiently modify the assemblies to satisfy demand for a specific color or design without making an entirely new assembly.

Thus, there is an opportunity to provide a diving snorkel assembly that includes a snorkel tube that may be formed from relatively cheap materials through relatively cheap manufacturing processes and that further does not require gluing to seal the snorkel tube and to provide structural reinforcement. Furthermore, there is an opportunity to provide diving snorkel assemblies that may be quickly and efficiently modified to satisfy demand for a specific color or design.

SUMMARY OF THE INVENTION AND ADVANTAGES

The subject invention provides a diving snorkel assembly including a snorkel tube. The snorkel tube includes a first portion and a second portion telescopically disposed relative to each other. The snorkel tube further includes an inner surface that defines an air passageway. The air passageway extends through the first portion and the second portion between a first end and a second end of the snorkel tube. A casing surrounds at least part of the first portion and the second portion. The casing includes an outer casing surface and an inner casing surface that both extend parallel to the snorkel tube. The inner casing surface defines an interior of the casing in fluid isolation from the air passageway.

The casing provides the advantage of cost effectiveness in manufacture of the assemblies since the first portion and the second portion of the snorkel tube may be first assembled, after which the snorkel tube may be placed in the casing and secured. Due to the fluid isolation between the air passageway and the interior of the casing, there is no requirement for gluing or otherwise sealing the casing, and mechanical mechanisms are sufficient to secure the casing in place without the use of glue. Furthermore, the snorkel tube may be formed through relatively cheap manufacturing processes, such as blow molding, and may be formed from relatively cheap materials that would be unfeasible, due to insufficient strength and surface appearance, in circumstances where the snorkel tube is directly exposed without the casing.

Another advantage of the present invention is that assemblies of various color or design may be quickly and efficiently manufactured by merely surrounding the snorkel tube with a modified casing. In this way, demand for a specific color or design may be satisfied by merely switching casings for the assemblies.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
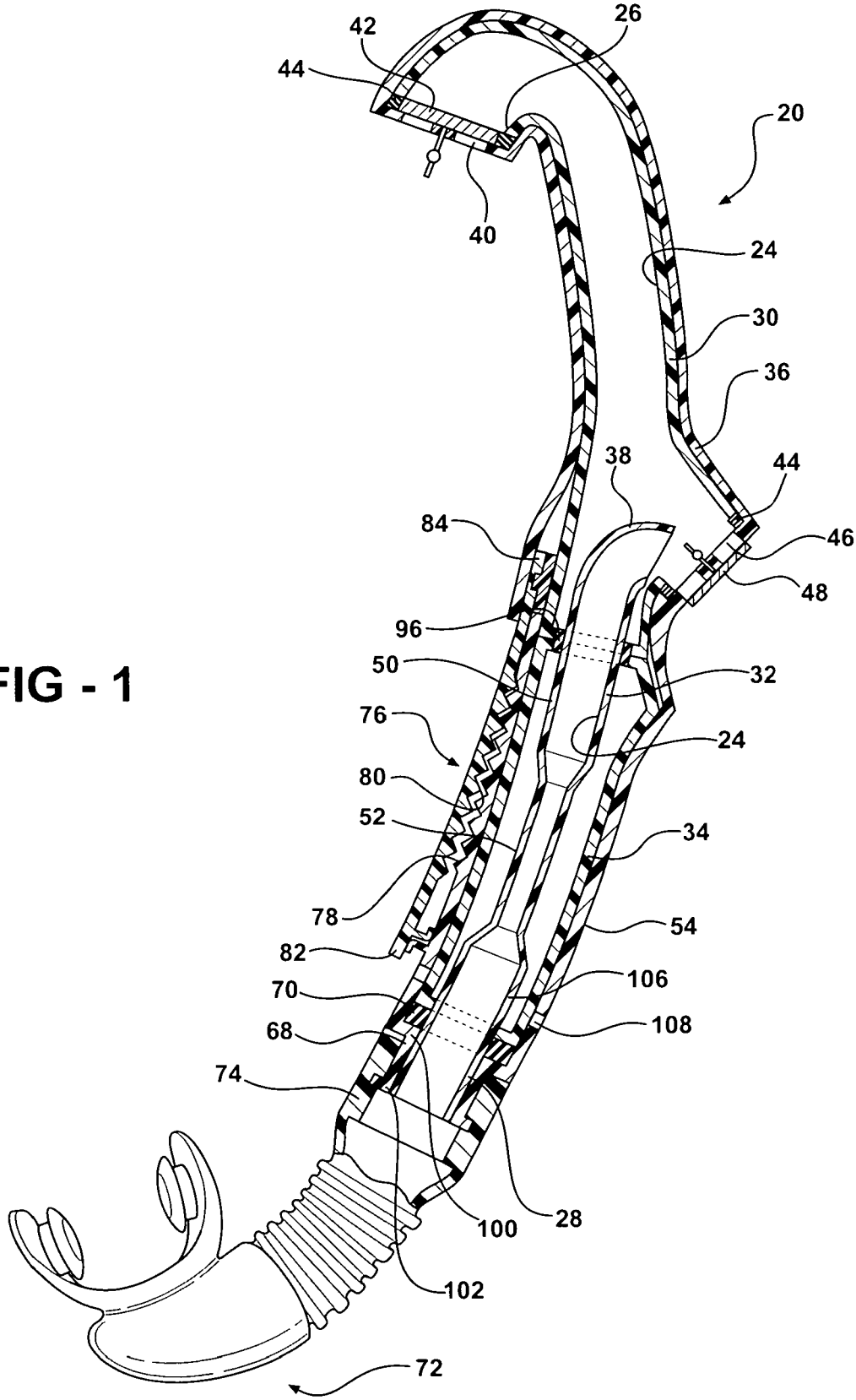
FIG. 1 is a partial cross-sectional side view of a diving snorkel assembly of the present invention including a snorkel tube having a first portion, a second portion, and a third portion.

Referring to the Figures, wherein like numerals indicate corresponding parts throughout the several views, a diving snorkel assembly is generally shown at 20 in FIG. 1. The diving snorkel assembly 20 includes a snorkel tube 22. The snorkel tube 22 includes an inner surface 24 defining an air passageway extending between a first end 26 and a second end 28 of the snorkel tube 22. The snorkel tube 22 includes a first portion 30 and a second portion 32. Optionally, the snorkel tube 22 includes a third portion 34, as shown in FIGS. 1 and 2–4; however, it is to be appreciated that the third portion 34 may be absent from the snorkel tube 22 or, alternatively, that the snorkel tube 22 may include more than the three portions 30, 32, 34.

The snorkel tube 22, more specifically the portions 30, 32, 34 of the snorkel tube 22, may be manufactured through any method as known in the art and may be formed from any material as known in the art. At least part of the first portion 30 and the second portion 32 of the snorkel tube 22 are surrounded by a casing 36, as described in further detail below. Typically, the casing 36 surrounds the snorkel tube 22 from substantially the first end to the second end 28 of the snorkel tube 22, as shown in FIG. 1. As such, the casing 36 protects the snorkel tube 22 from direct blunt forces and obscures the snorkel tube 22 from sight when in place.

Figure 3:
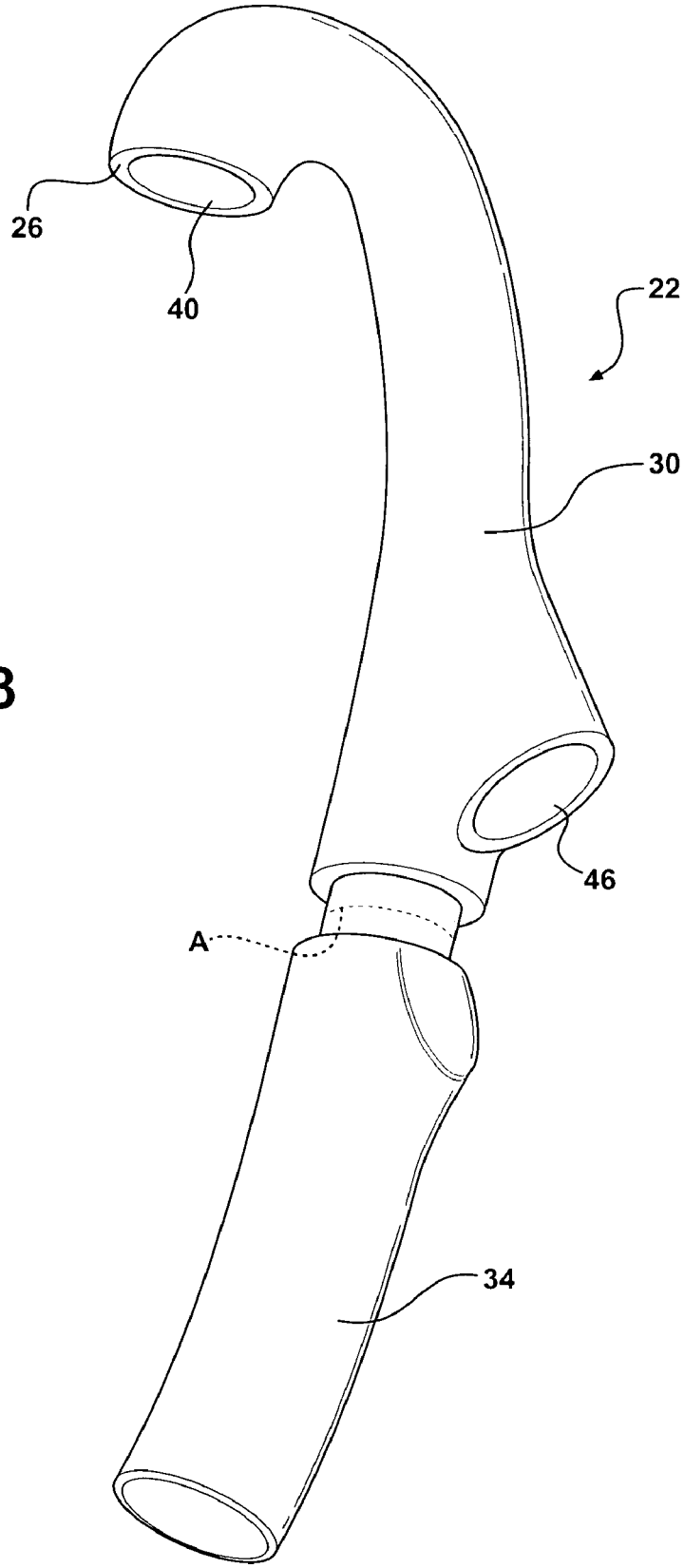
FIG. 3 is a perspective view of one embodiment of a snorkel tube of the present invention including a first portion and a third portion.
Figure 4:
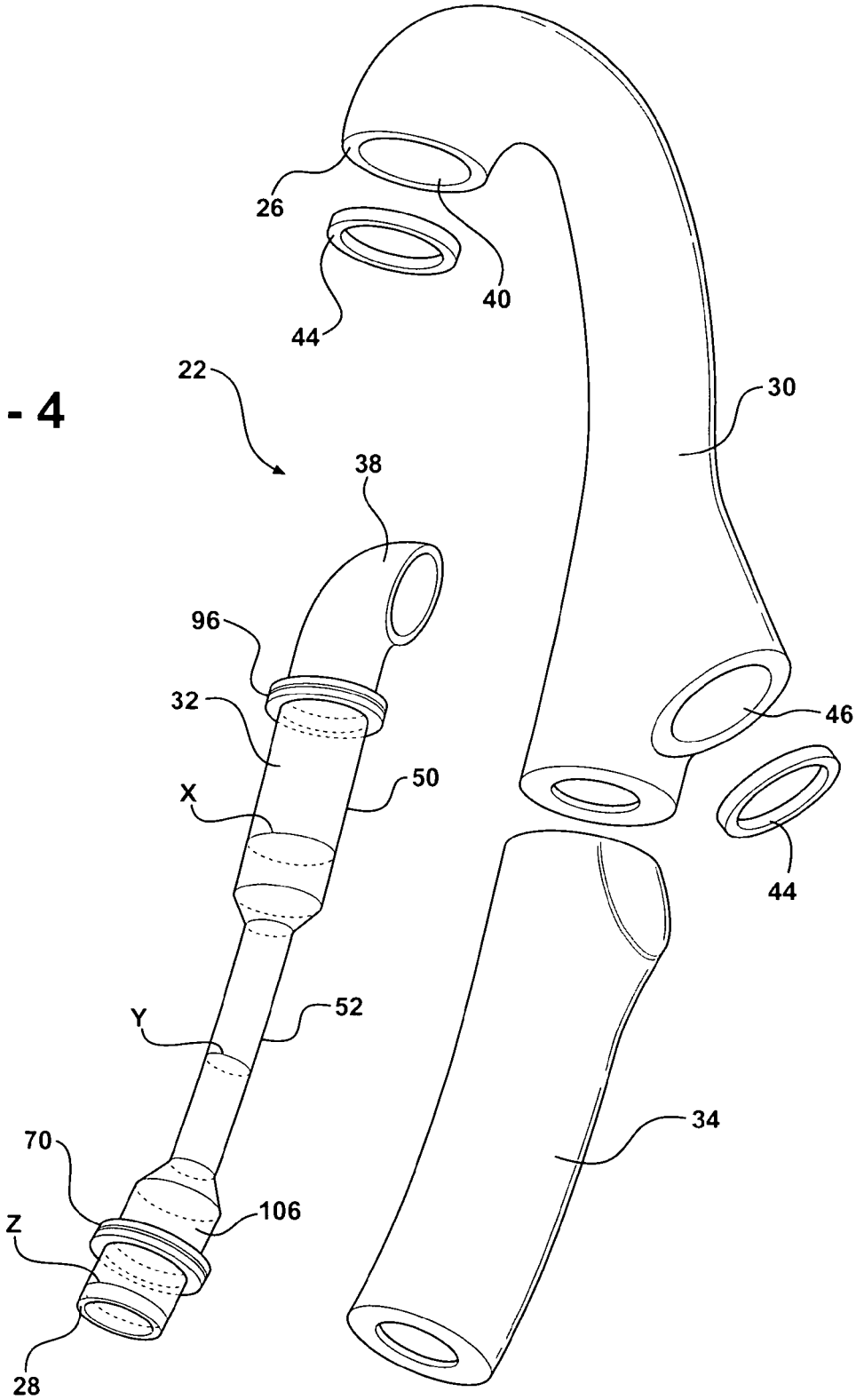
FIG. 4 is a perspective side view of the snorkel tube of FIG. 3 and a second portion after cutting the snorkel tube along line A to separate the first portion and the third portion.

In order to minimize cost of the diving snorkel assemblies, the portions 30, 32, 34 of the snorkel tube 22 are typically formed as cost-effectively as possible. Typically, the portions 30, 32, 34 are formed through blow molding, since surface appearance of the portions 30, 32, 34 are immaterial. Furthermore, the portions 30, 32, 34 are typically formed from a relatively low strength material, such as a thermoplastic, since strength of the portions 30, 32, 34 is also immaterial. To further increase manufacturing efficiency and lower costs, multiple portions 30, 32, 34 of the snorkel tube 22 may be formed together, and then cut apart after formation. For example, as shown in FIG. 3, when the snorkel tube 22 includes the first portion 30 and the third portion 34, the first portion 30 and the third portion 34 may be formed together, then cut along line A in order to separate the first portion 30 and the third portion 34.

As shown in FIG. 1, the first portion 30 and the second portion 32 are telescopically disposed relative to each other with the air passageway extending through the first portion 30 and the second portion 32. More specifically, the second portion 32 may extend into the first portion 30 for reasons to be discussed below. Optionally, when the snorkel tube 22 includes the third portion 34, in addition to the first portion 30 and the second portion 32, the second portion 32 and the third portion 34 may also be telescopically disposed relative to each other, in which case the third portion 34 may provide structural support to the second portion 32 of the snorkel tube 22. An interior of the third portion 34 is typically in fluid isolation from the air passageway and merely surrounds the second portion 32 to provide the structural support. However, it is to be appreciated that in certain circumstances, the air passageway may extend through the third portion 34, in which case additional seals (not shown) may be necessary to seal the air passageway.

The first portion 30 of the snorkel tube 22 typically includes a curved region 38 to angle the first end 26 of the snorkel tube 22 toward the water, when the diving snorkel assembly 20 is in use. However, it is to be appreciated that the first portion 30 may be substantially straight (not shown).

As shown in FIG. 1, the first portion 30 and the casing 36 define an air intake opening 40 adjacent to the first end 26 of the snorkel tube 22. At least one of the first portion 30 and the casing 36 may include an air intake valve 42 disposed across the air intake opening 40. When the casing 36 includes the air intake valve 42, a valve seal 44 encircles the air intake opening 40 and is disposed between the snorkel tube 22 and the casing 36 for preventing water from flowing into the air passageway since the casing 36 is typically not sealed. The shape of the first portion 30 dictates a configuration of the air intake valve 42 that can be effectively used in the diving snorkel assembly 20. For example, when the first portion 30 includes the curved region 38, the air intake valve disclosed in U.S. Pat. No. 5,239,990 (the '990 patent) to Delphia, the disclosure of which is hereby incorporated by reference, may be used. However, it is to be appreciated that any known air intake valve 42 may be used.

The first portion 30 and the casing 36 also typically define an air exhaust opening 46 in addition to the air intake opening 40. At least one of the first portion 30 and the casing 36 may include an air exhaust valve 48 adjacent the second portion 32. When the casing 36 includes the air exhaust valve 48, a valve seal 44 encircles the air exhaust opening 46 and is disposed between the snorkel tube 22 and the casing 36 for preventing water from flowing into the air passageway since the casing 36 is typically not sealed. A typical air exhaust valve 48 that is suitable for purposes of the present invention is also disclosed in the '990 patent to Delphia. The air exhaust valve 48 may be spaced from the air intake valve 42, as shown in FIGS. 1 and 2–4. The air exhaust valve 48 may also be angled away from the snorkel tube 22 and generally toward the second portion 32 of the snorkel tube 22. As a result, when the diving snorkel assembly 20 is in use, the air exhaust valve 48 is at about water level and angles toward the water. As discussed in further detail below, water collects adjacent to the air exhaust valve 48, and since the air exhaust valve 48 is at about water level during use, minimal air pressure is required to expel water out of the snorkel tube 22 through the air exhaust valve 48.

The second portion 32 of the snorkel tube 22, which may also be referred to as a "water pump", may include a first region 50 having a first cross-sectional area X, taken along a plane transverse to a length of the second portion 32, and a second region 52 having a second cross-sectional area Y, also taken along the plane transverse to the length of the second portion 32, that is smaller than the first cross-sectional area X. The second portion 32 typically includes a third region 106 having a third cross-sectional area Z that is about equal to the cross-sectional area of the first region 50. The third region 106 may be disposed adjacent to the second region 52 opposite the first region 50. The purpose of the second cross-sectional area Y being smaller than the first cross-sectional area X is to provide sufficiently increased air pressure through the second portion 32 for blowing any water that may accumulate in the second portion 32 out of the second portion 32, into the first portion 30, and out of the diving snorkel assembly 20 through the air exhaust opening 46.

The first region 50 of the second portion 32 is typically adjacent to the first portion 30. As set forth above, the second portion 32 may extend into the first portion 30. More specifically, the first region 50 of the second portion 32 may extend into the first portion 30 to allow the water to be blown into the first portion 30 and out of the diving snorkel assembly 20 through the air exhaust opening 46. The second portion 32 and, more specifically, the first region 50 of the second portion 32, may be curved toward the air exhaust valve 48 in the first portion 30 in order to direct air and water toward the air exhaust opening 46 for expulsion.

A first seal 96 is typically disposed between the first portion 30 and the second portion 32 for sealing the air passageway. The first seal 96 may be formed from a polymeric material, such as silicone. During manufacture of the diving snorkel assembly 20, the first seal 96 may be slid onto the second portion 32 of the snorkel tube 22, more specifically onto the first region 50. The second portion 32 may then be telescopically inserted into the first portion 30, without traveling past the air exhaust opening 46 to result in the configuration shown in FIG. 1. The first seal 96 forms a water-tight connection between the first portion 30 and the second portion 32. As set forth above, water collects adjacent to the air exhaust opening 46. More specifically, water collects in the first portion 30 adjacent to the first seal 96 and the air exhaust opening 46. The second portion 32 typically extends further into the first portion 30 than the first seal 96 such that small amounts of water may collect in the first portion 30 without flowing unhindered into the second portion 32. The water that collects in the first portion 30 may be expelled through the air exhaust valve 48.

As alluded to above, the diving snorkel assembly 20 further includes the casing 36. The casing 36 is typically visible to consumers and, as such, typically has an excellent surface appearance. Excellent surface appearance may be achieved by injection molding the casing 36. Furthermore, the casing 36 is typically formed from a material including color pigments to produce a desired color. Suitable materials for the casing 36 typically also have excellent strength for resisting cracking or breakage due to blunt forces. A suitable material for the casing 36 having sufficient strength is acrylonitrile-butadiene-styrene (ABS).

As also set forth above, the casing 36 surrounds at least part of the first portion 30 and the second portion 32, thereby providing structural reinforcement to the snorkel tube 22. Furthermore, the casing 36 secures the first portion 30 and the second portion 32 such that the first portion 30 and the second portion 32 are substantially fixed relative to each other. As a result, the first seal 96 disposed between the first portion 30 and the second portion 32 is sufficient to prevent water from entering the air passageway. Typically, the casing 36 extends parallel to the air passageway and surrounds the snorkel tube 22 from substantially the first end 26 to the second end 28 of the snorkel tube 22. As such, the snorkel tube 22 is typically completely surrounded by the casing 36. However, it is to be appreciated that in some circumstances, the casing 36 may be clear or may allow parts of the snorkel tube 22 to be exposed.

The casing 36 includes an outer casing surface 54 and an inner casing surface 56 that both extend parallel to the snorkel tube 22. The inner casing surface 56 defines an interior of the casing 36 in fluid isolation from the air passageway. As such, water may enter into the interior of the casing 36 without entering into the snorkel tube 22, and the air passageway in the snorkel tube 22 may be completely sealed with no sealing of the casing 36 required. The casing 36 may define at least one water drain 108 adjacent to the second end 28 of the snorkel tube 22 for allowing any water that enters the casing 36 to drain out.

The casing 36 is typically split along an axis parallel to the air passageway to define a first casing member 58 and a second casing member 60 in order to facilitate easy installation of the casing 36 around the snorkel tube 22 of the diving snorkel assembly 20. An interconnecting mechanism 62 is disposed between the first casing member 58 and the second casing member 60 for connecting the first casing member 58 and the second casing member 60 together. The interconnecting mechanism 62 typically includes a series of tabs 64 spaced along an edge 66 of one of the casing members 58, 60, with a corresponding ledge 98 protruding from the inner casing surface 56 of the other of the casing members 58, 60. The tabs 64 snap over the ledge 98, which hinders the tabs 64 from traveling back over the ledge 98.

Figure 5:
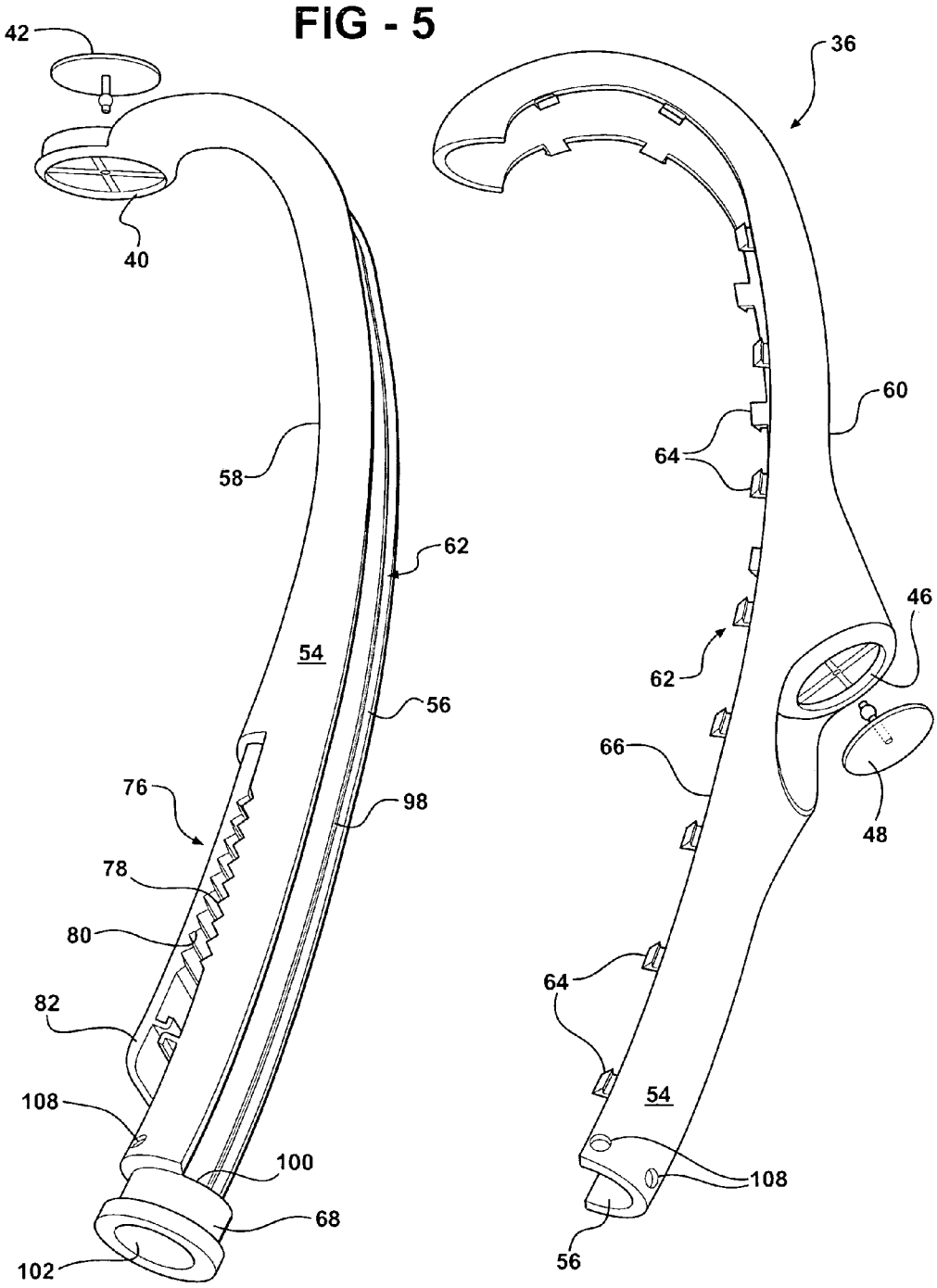
FIG. 5 is a partially exploded perspective view of a casing of the diving snorkel assembly shown in FIG. 1.

As shown in FIGS. 1 and 5, at least one of the first casing member 58 and the second casing member 60 typically includes a casing sleeve 68 adjacent to the second end 28 of the snorkel tube 22. In one embodiment, as shown in FIG. 1, the snorkel tube 22, more specifically the second portion 32 of the snorkel tube 22, telescopically extends into a first end 100 of the casing sleeve 68. A second seal may be disposed between the casing 36 and the second portion 32 adjacent to the casing sleeve 68 for sealing the casing sleeve 68 and the air passageway. More specifically, the air passageway may further extend through the casing sleeve 68. When the third portion 34 of the snorkel tube 22 is present, the third portion 34 may be disposed adjacent to the first end 100 of the casing sleeve 68, with the second seal 70 disposed between the third portion 34 and the first end 100 of the casing sleeve 68 and further disposed between the casing 36 and the second portion 32 of the snorkel tube 22.

Figure 2:
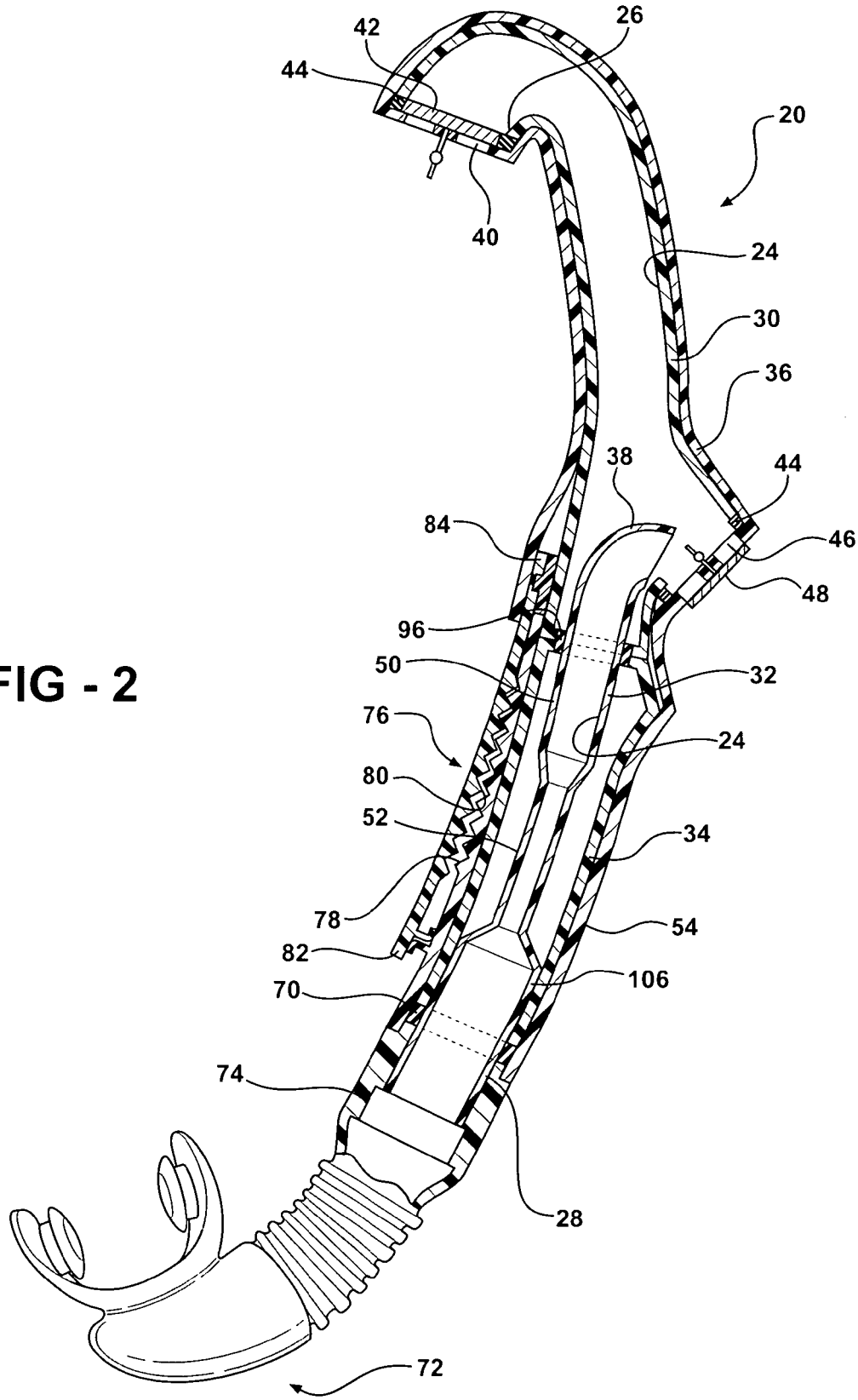
FIG. 2 is a cross-sectional side view of a portion of another embodiment of a diving snorkel assembly of the present invention including a snorkel tube having a first portion, a second portion, and a third portion.

In one embodiment, as shown in FIG. 1, a mouthpiece 72 is attached to a second end 102 of the casing sleeve 68 for allowing air to be drawn through the air passageway during use of the diving snorkel assembly 20. More specifically, the mouthpiece 72 may include a mouthpiece sleeve 74 that fits over the casing sleeve 68 to seal the mouthpiece 72 to the casing sleeve 68. In another embodiment, as shown in FIG. 2, the mouthpiece 72 may be attached to the second end 28 of the snorkel tube 22, specifically the second portion 32 of the snorkel tube 22, and the casing sleeve 68 may be absent from the casing 36.

Figure 6:
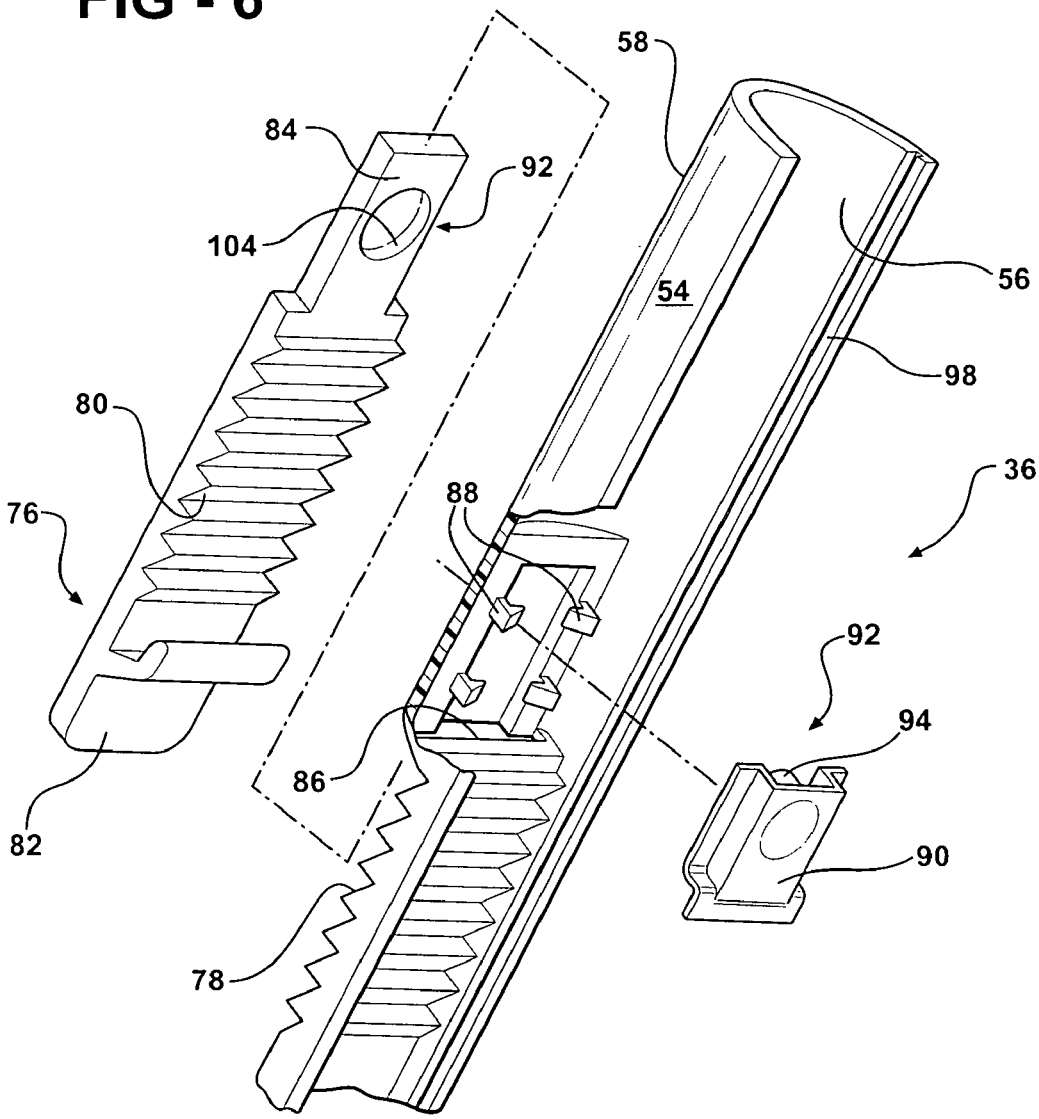
FIG. 6 is an exploded perspective view of a portion of the casing of FIG. 5 showing a clip.

Referring to FIGS. 1, 5, and 6, the diving snorkel assembly 20, more specifically the casing 36, further includes a clip 76 having a first gripping surface 78 fixed relative to the casing 36 and a second gripping surface 80 facing the first gripping surface 78. In one embodiment, the first gripping surface 78 is integral with the outer casing surface 54; however, it is to be appreciated that the first gripping surface 78 may be separately attached to the outer casing surface 54. The second gripping surface 80 is disposed on an arm 82 having a mounting flange 84. The casing 36 defines a slot 86 through the outer casing surface 54 and the inner casing surface 56 for receiving the mounting flange 84. The inner casing surface 56 includes at least one locking finger 88, typically at least two locking fingers 88, laterally offset from the slot 86 and extending inward toward the snorkel tube 22 from the inner casing surface 56. When the arm 82 is installed on the casing 36, the mounting flange 84 extends through the slot 86 and is seated adjacent to the at least one locking finger 88. A locking plate 90 engages the at least one locking finger 88, with the mounting flange 84 sandwiched between the inner casing surface 56 and the locking plate 90. The locking finger 88 secures the locking plate 90 in place and holds the locking plate 90 in contact with the mounting flange 84.

A locking mechanism 92 is disposed between the locking plate 90 and the mounting flange 84 for preventing the mounting flange 84 from movement out of the slot 86. More specifically, the locking plate 90 may include a post 94 that extends toward the mounting flange 84 when the locking plate 90 is in place, and the mounting flange 84 may define a recess 104 on a surface facing the locking plate 90 for receiving the post 94. As such, when the locking plate 90 is in place and the mounting flange 84 is disposed between the locking plate 90 and the inner casing surface 56, the post 94 extends into the recess 104 in the mounting flange 84 to prevent the arm 82 from laterally moving out of the slot 86 in the casing 36.

Obviously, many modifications and variations of the present invention are possible in light of the above teachings. The invention may be practiced otherwise than as specifically described within the scope of the appended claims. In addition, the reference numerals in the claims are merely for convenience and are not to be read in any way as limiting.

What is claimed is:

1. A diving snorkel assembly (20) comprising:

a snorkel tube (22) including a first portion (30) and a second portion (32) telescopically disposed relative to each other and an inner surface (24) defining an air passageway extending through said first portion (30) and said second portion (32) between a first end (26) and a second end (28) of said snorkel tube (22); and a casing (36) surrounding at least part of said first portion (30) and said second portion (32) and including an outer casing surface (54) and an inner casing surface (56) both extending parallel to said snorkel tube (22) with said inner casing surface (56) defining an interior of said casing (36) in fluid isolation from said air passageway, wherein said casing (36) is split along an axis parallel to said air passageway to define a first casing member (58) and a second casing member (60).

2. A diving snorkel assembly (20) comprising:

a snorkel tube (22) including a first portion (30) and a second portion (32) telescopically disposed relative to each other and an inner surface (24) defining an air passageway extending through said first portion (30) and said second portion (32) between a first end (26) and a second end (28) of said snorkel tube (22); and a casing (36) surrounding at least part of said first portion (30) and said second portion (32) and including an outer casing surface (54) and an inner casing surface (56) both extending parallel to said snorkel tube (22) with said inner casing surface (56) defining an interior of said casing (36) in fluid isolation from said air passageway, wherein said casing (36) extends parallel to said air passageway and surrounds said snorkel tube (22) from about said first end (26) to about said second end (28) of said snorkel tube (22).

3. A diving snorkel assembly (20) as set forth in claim 1 further comprising an interconnecting mechanism (62) disposed between said first casing member (58) and said second casing member (60) for connecting said first casing member (58) and said second casing member (60) together.

4. A diving snorkel assembly (20) as set forth in claim 3 wherein at least one of said first casing member (58) and said second casing member (60) includes a casing sleeve (68) adjacent to said second end (28) of said snorkel tube (22).

5. A diving snorkel assembly (20) as set forth in claim 4 wherein said snorkel tube (22) telescopically extends into a first end (100) of said casing sleeve (68).

6. A diving snorkel assembly (20) as set forth in claim 5 further comprising a second seal (70) disposed between said casing (36) and said snorkel tube (22) adjacent to said casing sleeve (68) for sealing said casing sleeve (68) and said air passageway.

7. A diving snorkel assembly (20) as set forth in claim 6 further comprising a mouthpiece (72) attached to a second end (102) of said casing sleeve (68).

8. A diving snorkel assembly (20) as set forth in claim 1 further comprising a mouthpiece (72) attached to said second end (102) of said snorkel tube (22).

9. A diving snorkel assembly (20) as set forth in claim 1 further comprising a first seal (96) disposed between said first portion (30) and said second portion (32) for sealing said air passageway.

10. A diving snorkel assembly (20) comprising:

a snorkel tube (22) including a first portion (30) and a second portion (32) telescopically disposed relative to each other and an inner surface (24) defining an air passageway extending through said first portion (30) and said second portion (32) between a first end (26) and a second end (28) of said snorkel tube (22); and a casing (36) surrounding at least part of said first portion (30) and said second portion (32) and including an outer casing surface (54) and an inner casing surface (56) both extending parallel to said snorkel tube (22) with said inner casing surface (56) defining an interior of said casing (36) in fluid isolation from said air passageway, wherein said first portion (30) and said casing (36) define an air intake opening (40) adjacent said first end (26) and an air exhaust opening (46) adjacent said second portion (32).

11. A diving snorkel assembly (20) as set forth in claim 10 wherein at least one of said first portion (30) and said casing (36) includes an air intake valve (42) disposed across said air intake opening (40) and an air exhaust valve (48) disposed across said air exhaust opening (46).

12. A diving snorkel assembly (20) as set forth in claim 11 further comprising a valve seal (44) encircling each of said openings (40, 46) and disposed between said snorkel tube (22) and said casing (36).

13. A diving snorkel assembly (20) comprising:

a snorkel tube (22) including a first portion (30) and a second portion (32) telescopically disposed relative to each other and an inner surface (24) defining an air passageway extending through said first portion (30) and said second portion (32) between a first end (26) and a second end (28) of said snorkel tube (22); and a casing (36) surrounding at least part of said first portion (30) and said second portion (32) and including an outer casing surface (54) and an inner casing surface (56) both extending parallel to said snorkel tube (22) with said inner casing surface (56) defining an interior of said casing (36) in fluid isolation from said air passageway, and a clip (76) having a first gripping surface (78) fixed relative to said casing (36) and a second gripping surface (80) facing said first gripping surface (78).

14. A diving snorkel assembly (20) as set forth in claim 13 wherein said second gripping surface (80) is disposed on an arm (82) having a mounting flange (84).

15. A diving snorkel assembly (20) as set forth in claim 14 wherein said casing (36) defines a slot (86) through said outer casing surface (54) and said inner casing surface (56) for receiving said mounting flange (84).

16. A diving snorkel assembly (20) as set forth in claim 15 wherein said inner casing surface (56) includes at least one locking finger (88) laterally offset from said slot (86) and extending inward toward said snorkel tube (22) from said inner casing surface (56).

17. A diving snorkel assembly (20) as set forth in claim 16 wherein said mounting flange (84) extends through said slot (86) and is seated adjacent to said at least one locking finger (88).

18. A diving snorkel assembly (20) as set forth in claim 17 further including a locking plate (90) engaging said locking finger (88) with said mounting flange (84) sandwiched between said inner casing surface (56) and said locking plate (90).

19. A diving snorkel assembly (20) as set forth in claim 18 further comprising a locking mechanism (92) disposed between said locking plate (90) and said mounting flange (84) for preventing said mounting flange (84) from movement out of said slot (86).

20. A diving snorkel assembly (20) as set forth in claim 2 further comprising a first seal (96) disposed between said first portion (30) and said second portion (32) for sealing said air passageway.

* * * * *